US005377540A

United States Patent [19]

Songe, Jr. et al.

[11] Patent Number: 5,377,540

[45] Date of Patent: Jan. 3, 1995

[54] OIL AND GAS WELL LOGGING SYSTEM

[76] Inventors: Lloyd J. Songe, Jr., 3736 E. Park Ave., P.O. Box 176, Bourg, La. 70343; Jimmy Pertuit, P.O. Box 249, Raceland, Pa. 70394

[21] Appl. No.: 82,807

[22] Filed: Jun. 25, 1993

Related U.S. Application Data

[63] Continuation of Ser. No. 576,268, Aug. 31, 1990, abandoned.

[51] Int. Cl.[6] ..... E21B 47/09

[52] U.S. Cl. ..... 73/151; 73/152; 166/255

[58] Field of Search ..... 73/151, 152; 166/250, 166/255

[56] References Cited

U.S. PATENT DOCUMENTS

| | | | |
|---|---|---|---|
| 2,390,178 | 12/1945 | Rutherford | 73/151 |
| 2,930,137 | 3/1960 | Arps | 73/151 |
| 3,027,649 | 2/1962 | Sloan | 33/129 |
| 3,367,179 | 2/1968 | Moore | 73/151 |
| 3,390,574 | 2/1966 | Jones | 73/133 |
| 3,474,539 | 7/1966 | Moore | 33/126 |
| 3,538,761 | 3/1968 | Horton et al. | 73/133 |
| 3,902,361 | 9/1975 | Watson | 73/151 |
| 3,916,684 | 11/1975 | Rundell | 73/151.5 |
| 4,064,749 | 12/1977 | Pittman | 73/152 |
| 4,105,070 | 8/1978 | Lavigne et al. | 73/151 |
| 4,137,762 | 2/1979 | Smith | 73/151 |
| 4,674,328 | 6/1987 | Ward et al. | 73/151 |
| 4,787,244 | 11/1988 | Mikolajczyk | 73/151 |

*Primary Examiner*—Thomas P. Noland
*Assistant Examiner*—George M. Dombroske
*Attorney, Agent, or Firm*—Pravel, Hewitt, Kimball & Krieger

[57] ABSTRACT

A method and apparatus for oil and gas well logging is provided wherein a mechanical feeler tool apparatus registers weight changes in a non-electric wireline or slick line that supports the feeler tool and a chart recorder prints a continuous record that can be compared with existing oil well profile information for accurate placement of the downhole tools thereafter, by using the slick line. The method uses a scaled printout wherein weight changes are reflected on the print out at precise elevational positions responsive to weight change information sensed by a load cell.

13 Claims, 3 Drawing Sheets

OIL AND GAS WELL LOGGING SYSTEM

This is a continuation of co-pending application Ser. No. 07/576,268 filed on 31 Aug. 1990 now abandoned.

BACKGROUND OF THE INVENTION

1. Field of the Invention

The present invention relates to oil well logging and more particularly to an improved method and apparatus for oil and gas well logging wherein a mechanical feeler tool engages each casing collar and causes weight change in a non-electric wireline or slick line that supports the feeler tool, and a chart recorder prints a continuous record that can be compared with existing "as built" well profile information for insuring accurate placement of downhole tools thereafter, using the calibrated slick line.

2. General Background

A "slick line" unit is used in numerous operations performed in an oil and gas well. A "slick line" is basically a non-electric wireline or conductor cable of usually metallic construction. As an example, one of the operations that can be performed using a slick line is the perforation of a joint of well casing. The oil company has an accurate log of the well, defining the exact elevational position of each section of casing, and each joint or collar between sections of casing.

A problem exists when a particular location on a section of casing must be accurately identified a slick line unit does usually have a meter to reflect the length of line that has payed out into the well. However, before perforating a section of casing, as an example, the oil company engineers must be absolutely certain that the slick line unit has positioned the perforating equipment in the exact position desired. Merely reading the meter of the slick line unit to determine how much line has payed out is not good enough. It is an object of the present invention to provide an accurate record in the form of a written log, of various downhole information to be used thereafter in conjunction with slick line operations. The system of the present invention provides an improved method of logging downhole using a slick line to provide slick line units with accuracy of placement in the well bore that was not heretofore available.

An improved process for logging (recording) collars on a non-electric wireline (slick line) uses a recorder with graph paper timed precisely to the movement of the wire on a scale. The scale can be required to match an oil company well log for that well. A device to accurately measure the line load is placed in a position to get an accurate reading. The load measurement device of the present invention is capable of triggering a solenoid upon a fluctuation in weight (either higher or lower) on the line. A feeler tool is provided to hang up in the space between the joints of pipe and is placed on the tool string to be sent down the well. As this tool is lowered or raised at a slow speed the weight of the tool string remains constant until the time when the tool contacts the space between the joints of pipe. This contact causes an increase or decrease in weight depending on the direction of travel of the feeler tool. This weight fluctuation is monitored by a weighing device located at the wellhead area. This increase or decrease will activate a solenoid on the high side or low side depending upon direction of travel. Solenoids mounted on the recorder (which is timed to move at a rate coordinated with the payout of the cable) cause a pin (in a neutral position) to travel right or left depending upon which solenoid is tripped, thus logging (recording) the collars in the well.

Various patent have issued that relate to well logging, and the use of elongated lines in an oil well environment wherein length of line information is desired.

U.S. Pat. No. 3,027,649, entitled "Depth Measuring System", issued to R. W. Sloan, discloses a method and apparatus for accurately and continuously determining the length of an elastic wire or cable under tension and more particularly to the measurement of the true position of a device suspended from an elastic wire or cable whose length varies with change in the tension applied thereto, as when the cable is payed out and taken in to change the position of the device. This device is adapted for use in the logging of a well wherein there is generally recorded some characteristic of earth strata adjacent a well bore as a function of depth. The earth characteristic is obtained by employing an exploration unit or instrument, frequently and generically referred to herein as a logging tool, suspended within a well bore by means of a cable, the length of which may be changed by cable-reeling means located at the surface. The log is generally made while moving the tool uphole or downhole by means of the cable. The cable length is continuously measured or computed to obtain a continuous indication of the tool position within the well bore.

U.S. Pat. No. 3,390,574, entitled "Ton-Mile Marker", issued to W. N. Jones, discloses an apparatus for continuously integrating and indicating on a digital counter the product of tensile load and distance traveled of any flexible line which operates a weighted apparatus such as a traveling block thereby providing an indication of ton-miles.

U.S. Pat. No. 3,538,761, entitled "Ton Mileage Recorder", issued to H. D. Horton et al., discloses a ton mileage recorder for integrating work to which the wire rope and related apparatus of the draw works of a drilling rig is subjected. A travel sensor in the form of a hydraulic pump which is actuated by the traveling wire rope provides power fluid which drives a hydraulic motor. A weight sensor actuates a cam which in turn controls fluid flow from the motor. The motor drives a gear box which in turn is connected to an odometer having indicia thereon in the usual manner. Hence the weight sensor cooperates with the travel sensor by means of the cam which is associated with the pump to thereby integrate the distance which the wire rope travels while being subjected to a finite weight.

U.S. Pat. No. 3,474,539, entitled "Pipe Collar Locator And Method Of Using Same", issued to L. K. Moore, discloses a method and device for locating collars in a pipe, wherein a mechanical device having a catch finger is lowered on a nonelectrical flexible line for engaging the catch finger in a collar upon an upward pull on the flexible line, so that upon an operator observing the increased weight on a weight indicator due to the catch finger engaging in the collar, the length of the flexible line in the pipe can be determined to thus determine the elevation of the collar.

U.S. Pat. No. 3,916,684, entitled "Method And Apparatus For Developing A Surface Well-Drilling Log", issued to Herbert A. Rundell, discloses a method or system for developing a surface drilling log indicative of one or more parameters of the formation being drilled. Measurements include the bit revolutions, the depth of the bit in the hole, the weight on the bit, and a determination of tooth dullness of the bit. The results are correlated to produce a parameter in accordance with the predetermined relationship of the measurements and the determination.

U.S. Pat. No. 4,064,749, entitled "Method And System For Determining Formation Porosity", issued to Robert W. Pittman et al., discloses a method and/or system for measuring formation porosity from drilling response. It involves measuring a number of drilling parameters and includes a determination of tooth dullness as well as determining a reference torque empirically. One of the drilling parameters is the torque applied to the drill string.

U.S. Pat. No. 4,137,762, entitled "Wireline Apparatus For Use In Earth Boreholes", issued to William D. Smith, discloses a wireline that comprises one or more insulated conductors contained within a smooth walled metal sheath; which wireline is used to perform all of the normal wireline operations in an earth borehole and particularly in very deep boreholes; and in which the sheath material of the wireline is a metal having a high yield strength to weight ratio, and the sheath is swaged into intimate contact with the inner insulated conductor or conductors, such that the weight of the inner conductor or conductors and insulation is effectively supported by the sheath.

U.S. Pat. No. 4,787,244, entitled "Well Pipe Or Object Depth Indicator", issued to Raymond F. Mikolajczyk, discloses a movement measuring device which includes circuitry which produces signals functionally related to the amount and direction of movement of a cable or drill line in relation to up and down movement of an object such as pipe and the like in a well bore. A totalizer device is provided with circuitry that is coupled to the movement measuring device to instrumentally display the object depth in the well bore resulting from the signals received from the movement measuring device. A switch is operatively connected to the cable or drill line and a device closes the switch when a predetermined weight or load on the cable or drill line is exceeded to provide power from a power source to the movement measuring device for transmitting the signals therefrom to the totalizer device. The totalizer device continuously displays the total depth of the object in the well bore.

SUMMARY OF THE INVENTION

The present invention solves the prior art problems and shortcomings relating to well logging wherein a written well log is needed for accurate definition of well collars for use in combination with slick line operations. The present invention provides a method of logging a well having connected joints of casing or tubing wherein a sensing tool is lowered into the well on an elongated lifting line and at the wellhead area. The length of line that is payed into the well is monitored in order to define the elevational position of the sensing tool in the well. A weight indicator is used to monitor the load being carried by the line at a position at the wellhead area. Changes in load are sensed when the sensing tool engages an obstruction in the well, such as a collar between joints of casing or tubing. A visible indicator is printed at intervals along a chart of the various well irregularities, such as the collars, that are between joints of casing or tubing whenever the weight indicator senses a weight change variance above a preselected permissible weight change value.

In the preferred method, the sensing tool monitors changes in the monitored load of between 25 and 100 pounds.

In the preferred embodiment, the visible record is printed on a chart wherein a continuous generally straight line is printed along a first axis and the weight variance in order to located irregularities, such as collars, comprises lines forming an angle with the continuous line.

In the preferred method, the sensing tool has at least three radially spaced apart leaf springs thereon.

In the preferred method, the width indicator is removed from the lifting line.

In the preferred method, a sheave engages the lift line and the weight indicator monitors the lift line load value by load transfer via the sheave.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
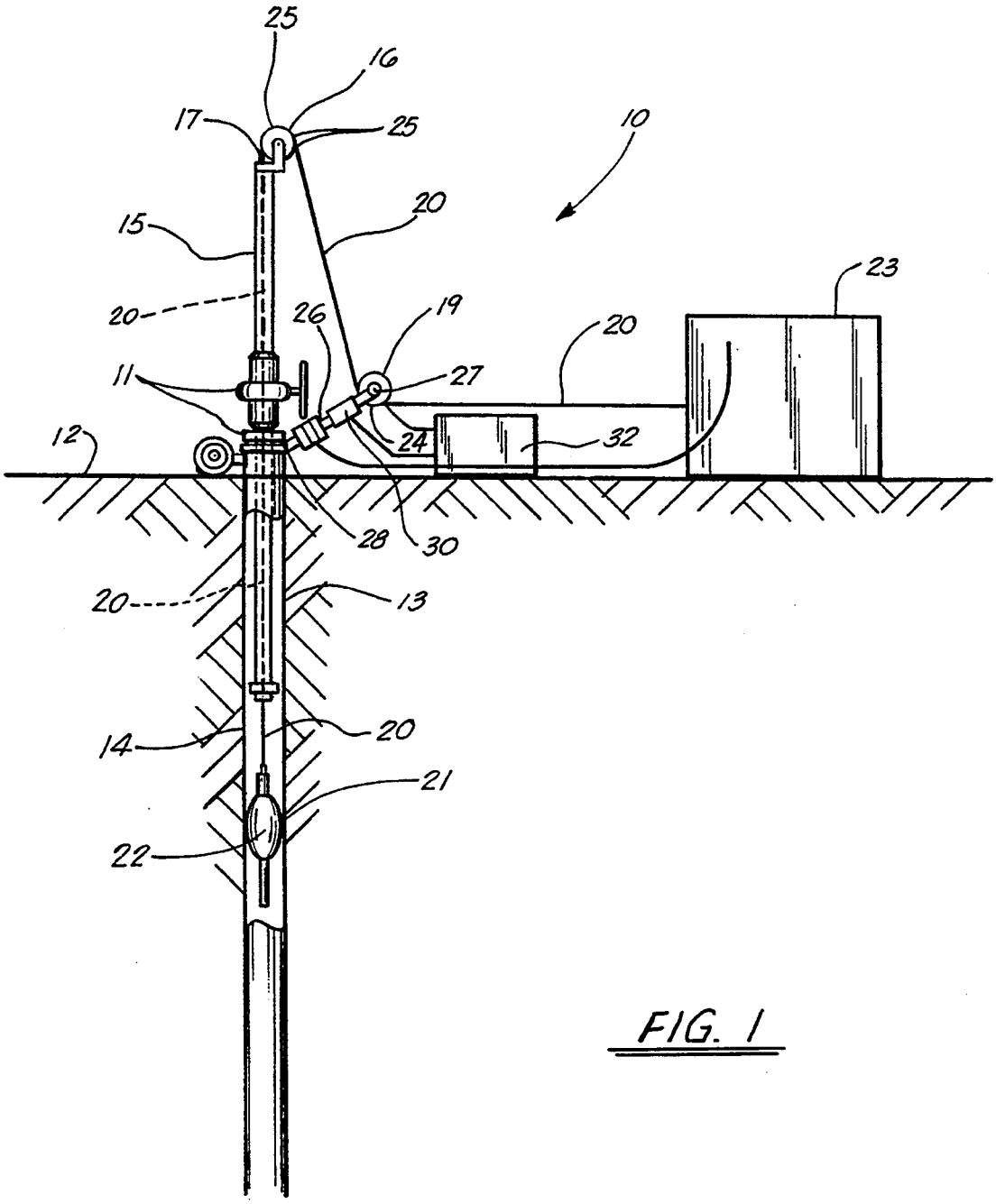
FIG. 1 is a schematic, elevational view of the preferred embodiment of the apparatus of the present invention.
Figure 2:
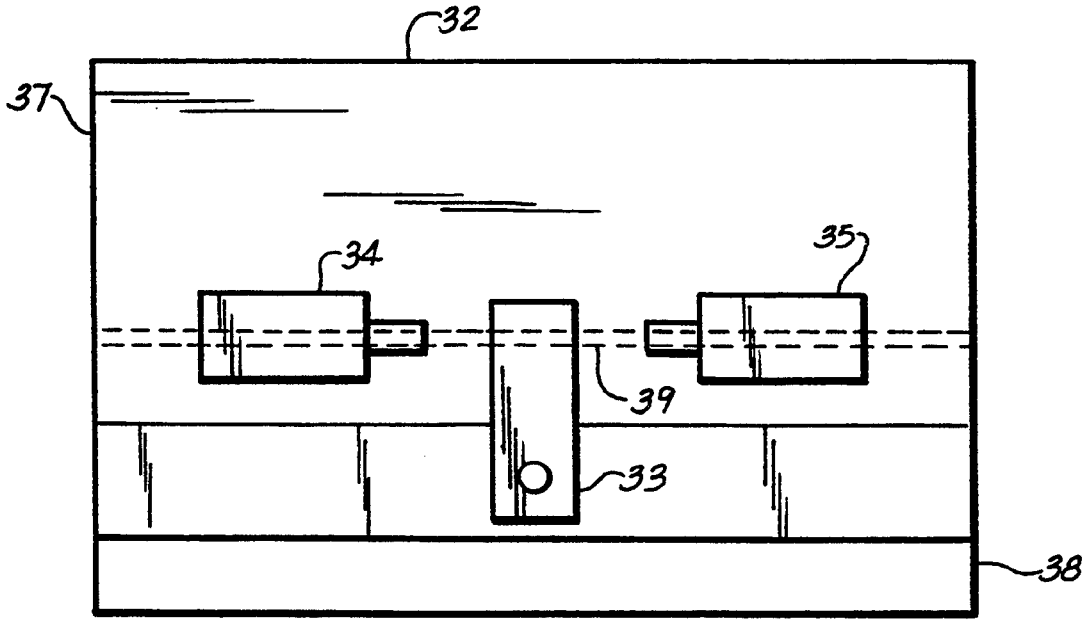
FIG. 2 is a schematic view of the chart recorder portion of the preferred embodiment.

FIGS. 1 and 2 illustrate the preferred apparatus of the present invention designated generally by the numeral 10. In FIG. 1, there can be seen a wellhead 11 adjacent the ground surface 12 and a well bore 13 formed by a plurality of hollow joints of casing, the casing being schematically illustrated by the numeral 14. It should be understood that the placement of a well having well bore 13 by using a plurality of joints of casing, and each having a collar forming the interface between adjacent casing sections is well known in the art. The casing 14 extends well below the surface 12 to thus define the oil and gas well having, for example, thousands of feet of depth below surface 12.

Superstructure tube 15 supports uppermost sheave 16 that engages line 20, with an internal open ended bore 17 of superstructure tube 15 that allows slick line 20 to pay out into the well. Slick line 20 carries feeler tool 21 at its lower end portion as shown in FIG. 1. Feeler tool 21 includes a plurality of, for example, three (3) leaf springs thereon, each designated by the numeral 22.

Second sheave 19 interfaces with slick line 20 and with a slick line power unit 23 (which is commercially available) for paying the line 20 out and into the well bore 13. Slick line 20 leaves power unit 23 and engages the underside of sheave 19 at 24. Line 20 then extends upwardly to engage upper sheave 16, wrapping around the top 25 thereof.

Slick line 20 exits sheave 16 and assumes a substantially vertical orientation as it pays out through the bore 17 of superstructure 15, through wellhead 11, and into the well bore 13 as shown in FIG. 1. Strut 26 forms a connection between sheave 19 at pinned connection 27, and wellhead 11 at connection 28. Strut 26 also carries load cell 30 which monitors the tensile load in slick line 20 by measuring tensile load of the strut which is transferred to strut 26 via sheave 19. Load cell 30 communicates with recorder 32, continuously monitoring the load value of tension in slick line 20. Recorder 22 also monitors the amount of line that has payed out from power unit 23. Recorder 32 can be a commercially available chart recorder, such as Gearhart-Owens Model 029852-02, modified in accordance with FIG. 2 and the specification hereinafter.

In FIG. 2, recorder 32 is shown in its modified construction in accordance with the apparatus of the present invention. Recorder 32 as modified includes added parts, namely a pen carrier 33 (that includes an ink pen for printing on graph paper), slide bar 39 and a pair of solenoids, including low side solenoid 34 and high side solenoid 35. During operation, the chart recorder has a gear drive that pulls scaled chart paper at a constant rate so that the ink pen portion of the pen carrier 33 prints a substantially straight vertical line on the scaled graph paper. The printed line thus reflects the amount of line 20 which has payed out into the well bore 13, as well as the depth location of feeler tool 21. The chart recorder can be roughly positioned first at an elevation of, e.g., 15,000 feet below the well surface area using a depth position mechanical "counter" on the commercially available slick line unit, or on the recorder 32. However, the mechanical counters on the slick line unit and on the chart recorder (as opposed to the written chart record) are prone to error, and cannot be relied upon for accurate elevational position. The mechanical counters will position the feeler tool very close to the correct area to be logged (e.g., within twenty five—thirty feet if the elevational position in the well is fifteen thousand feet (15,000') below the well head. When logging begins, the feeler tool 21 engages each casing collar and very accurately reflects the distance between adjacent casing collars. After five-ten collars are logged, the printed chart record is then overlayed on the oil company "as built" log which accurately defines the location of each joint and each collar. This procedure accurately calibrates the slick line unit and feeler tool 21 position.

Solenoids 34, 35 are provided to move the pen and pen carrier 33 respectively to either the left side, low side 37 (toward low side solenoid 34) if a low minimum value of line load is reached or the right high side 38 (toward high side solenoid 35) if a high load limit is reached in the weight of line 20. A slide bar 39 can be used to interface the solenoids 34, 35 and the pen carrier. An electrical signal from the load cell 30 triggers the solenoids 34, 35 when there is an increase or decrease in weight, e.g., twenty five pounds (25 lbs.) above or below the load value at that time. However, the triggering load variation can be varied. However, pneumatic or hydraulic instrumentation known in the art could be used to "trigger" solenoids 34, 35 when feeler tool 21 engages a casing collar and line 20 weight rises (or falls) sharply.

The user calibrates recorder 32 with preset minimum and maximum load values. The user first monitors line load value to determine a span of variance that occurs when the feeler tool 21 reaches a well obstruction, typically a casing collar. As line pays out into the well bore, load on line 20 is increasing. But, logging of the well typically tracks about one hundred-three hundred feet of the section of well so that the change in line weight is negligible other than when a collar is engaged by feeler tool 21.

For a particular well, the feeler tool 21 is pulled upwardly through several casing collars. The user might note for example that the weight value raises by a measure of about fifty pounds about every thirty feet of line 20 retrieval. Since the user knows about how many feet there are in each casing joint, the user knows that the fifty-pound increase signifies that a casing collar has been engaged by the feeler tool 21. In lowering the feeler tool 21, into the well bore 13, the user will notice that the weight value decreases by fifty pounds for example as each casing collar is engaged by the feeler tool 21.

In summary, the engagement of the feeler tool 21 with the casing collar causes the monitored load value or weight of line 20 to increase when the line is being pulled in and feeler tool 21 is rising in the well. If the feeler tool 20 is being lowered into the well, the monitored load value or weight of line 20 decreases as each collar is engaged by the feeler tool 21. The user sets the solenoids 34 to pull the pin 33 to the left side 37 if weight decreases more than forty pounds. Solenoid 35 is set to pull pin 33 to high side 38 if weight increases more than forty pounds.

The user gets a continuous graphic, scale print out which reflects the specific location in feet of each collar and in relation to the amount of the line that has been payed out by the slick line power unit 23.

Once a load value is determined for the amount of variance that is showing up for a particular well when the feeler tool 21 engages a collar in that well, the user can then set up the recorder 32 so that the solenoids 34, 35 trigger the pin carrier 33 to the low side or the high side whenever the pre-selected weight increase or weight decrease is achieved. Typically, this is in the range of 25-100 pounds of either weight increase or weight decrease. Therefore, solenoids 34, 35 are adjusted so that an increase of monitored weight above a maximum variance of for example forty pounds causes the high side solenoid 35 to pull the pin to the high side 38. If the weight has decreased below the pre-selected minimum variance of for example forty pounds the solenoid 34 pulls the pin 33 to the low side.

Figure 3:
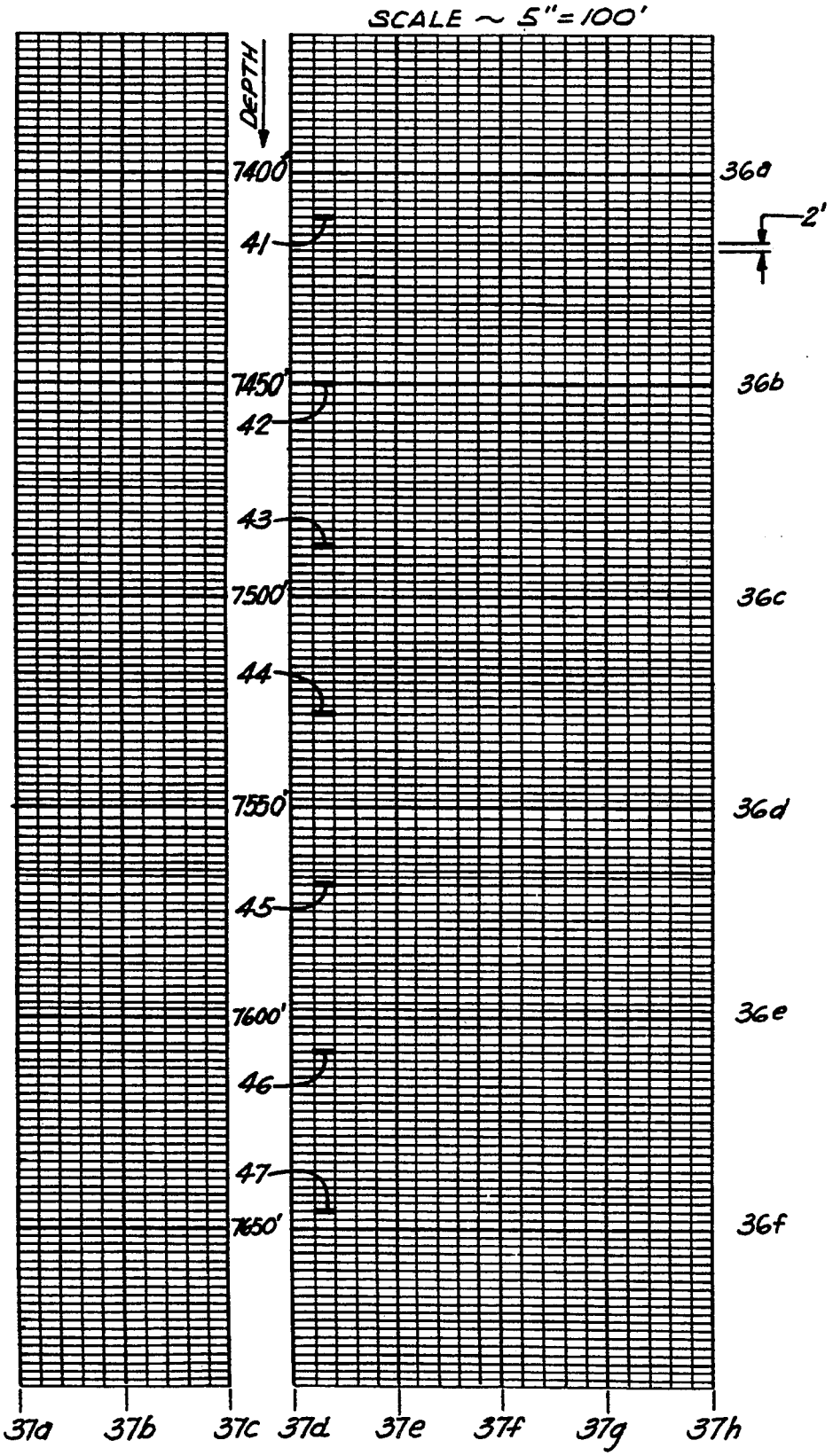
FIG. 3 is a schematic view of the written well log produced by the method of the present invention.

In FIG. 3, printed chart record is illustrated as made according to the method and apparatus of the present invention. The chart includes X and Y coordinate axes designated by the numbers 36*a–f* and 37*a–h* respectively. Line 40 indicates a continuous printout parallel to the Y axes 37*a–h* and which shows on the X axes 36*a–f* the length of slick line 20 that has been payed into the well bore 13 and thus the depth at which feeler tool 21 is positioned and the well X axis 36*a* shows an exemplary well depth of 7400 feet while X axis 36*e* shows a depth of 7600 feet. In the example of FIG. 3, casing collars are located at line 41 at a depth of 7410 feet and at line 42 at a depth of 7449 feet for example. The plurality of transverse lines 41–47 illustrate laterally extending lines caused by the solenoid 35 having pulled the pin carrier 33 to the high side 38 of recorder 32, indicating that a weight increase above a threshold value has been reached because the feeler tool 21 has engaged a well casing collar as line 20 is withdrawn from the well bore 13. This continuous printout of FIG. 3 is precise as to well collar location. Because it is a scale printout, and because it indicates the exact position in feet with regard to the elevation of each collar in the well, the oil company can use the FIG. 3 log and compare it with their existing logs of precise well casing locations and determine exactly how accurate the slick line is, thus providing an excellent calibration. Once the FIG. 3 type log is prepared, the oil company can place the FIG. 3 type log against their own well log which was prepared at the time the well was drilled and be confident that the slick line is in the exact position that they want it in and that the pay out values on the slick line are extremely accurate.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method of logging a well having connected joints of casing or tubing wherein the well joint and collar locations are defined by an as-built oil well profile, comprising the steps of:

a) lowering a sensing tool into the well on a slick elongated lifting line and at the wellhead area;

b) using a counter wheel to monitor the length of line that is payed out into the well in order to define the elevational position of the sensing tool in the well;

c) using a weight indicator to monitor the load being carried by the line and at a position at the wellhead;

d) sensing a change in load when the sensing tool engages an obstruction in the well;

e) printing a continuous chart of well depth that gives a written indication of well depth value for the sensing tool; and f) printing a visible indicator at multiple intervals on the chart of various multiple well irregularities when the weight indicator senses a weight change variance above a pre-selected permissible weight change value and (g) comparing the multiple indicating marks of the continuous chart of well depth with multiple irregularities on the existing as-built oil well profile information.

2. The method of claim 1 wherein the sensing tool monitors changes in the monitored load of between twenty-five and one hundred pounds.

3. The method of claim 1 wherein in step "f", the weight variance indicating marks form an angle with the continuous line, in order to clearly show the locations of irregularities in a borehole casing.

4. The method of claim 1 wherein the sensing tool has at least three, radially-spaced leaf springs thereon.

5. The method of claim 1 wherein in step "a" the weight indicator is spaced from the lifting line.

6. The method of claim 1 wherein in step "c" a sheave engages the lift line, and the weight indicator monitors the lift line load by load transfer via the sheave.

7. The method of claim 1, further comprising the step of:

g) comparing the continuous chart of well depth with existing oil well profile information.

8. The method of claim 7, further comprising the step of:

h) using the comparison in step "g", accurately placing downhole tools connected to the elongated lifting line at a desired location in the well.

9. A method of logging a well having connected joints of casing or tubing wherein the well joint and collar locations are defined by an as-built oil well profile, comprising the steps of:

a) lowering a sensing tool into the well on a slick line and at the wellhead area;

b) using a counter wheel to monitor the length of slick line that is payed out into the well in order to define the elevational position of the sensing tool in the well;

c) using a weight indicator to monitor the load being carried by the line and at a position at the wellhead;

d) sensing a change in load when the sensing tool engages an obstruction in the well;

e) printing a continuous chart of well depth that gives a written indication of well depth value for the sensing tool;

f) printing a visible indicator at multiple intervals on the chart of various, multiple well irregularities when the weight indicator senses a weight change variance above a pre-selected permissible weight change value, wherein the chart prints a continuous line along a first axis and multiple weight variance indicating marks form an angle with the continuous line, in order to clearly show the locations of irregularities in a borehole casing;

g) comparing the multiple indicating marks of the continuous chart of well depth with multiple irregularities on the existing as-built oil well profile information; and h) using the comparison in step "g" to accurately place downhole tools connected to the slick line of steps "a" and "b" at a desired location in the well.

10. The method of claim 9 wherein the sensing tool monitors changes in the monitored load of between twenty-five and one hundred pounds.

11. The method of claim 9 wherein the sensing tool has at least three, radially-spaced leaf springs thereon for sensing the location of collars in a well bore.

12. The method of claim 11 wherein in step "a" the weight indicator is spaced from the lifting line.

13. The method of claim 12 wherein in step "c" a sheave engages the lift line, and the weight indicator monitors the lift line load by load transfer via the sheave.

* * * * *